United States Patent [19]

Tanney

[11] 3,971,149

[45] July 27, 1976

[54] DISPLAY DEVICE

[75] Inventor: Oliver Morley Tanney, Englewood, N.J.

[73] Assignee: Goodren Products Corporation, N.J.

[22] Filed: June 18, 1975

[21] Appl. No.: 587,896

[52] U.S. Cl. ..... 40/126 A
[51] Int. Cl.[2] ..... G09F 19/00
[58] Field of Search ..... 40/124.1, 126 A, 125 A, 40/126 R; 46/35

[56] References Cited

UNITED STATES PATENTS

| | | | |
|---|---|---|---|
| 1,202,108 | 10/1916 | Schmidt | 40/126 A |
| 2,115,449 | 4/1938 | Pradt | 40/124.1 |
| 2,255,535 | 9/1941 | Sauer | 40/124.1 |

*Primary Examiner*—Louis G. Mancene
*Assistant Examiner*—John H. Wolff
*Attorney, Agent, or Firm*—Brumbaugh, Graves, Donohue & Raymond

[57] ABSTRACT

A display device, for advertising or other purposes, is adapted for arrangement into a three-dimensional configuration and includes a printed sheet divided into first and second sections along a fold line. Adhesive on the back of one section secures the display on a supporting surface. Adhesive on the front, printed surface, close to the fold line, and adhesive near the edge of the remaining section remote from the fold line permit that section to be curled back from the fold line and held in a cylindrical or other three-dimensional shape. The adhesive near the fold line secures adjacent front surface portions face-to-face when the sheet is creased along the fold line. The adhesive near the edge affixes that edge to the sheet back near the crease. The face-to-face adhesion at the crease reduces movement of the three-dimensional shape, and in the case of a cylinder, maintains the cylindrical shape and accurately locates the cylinder.

8 Claims, 6 Drawing Figures

FIG. 1
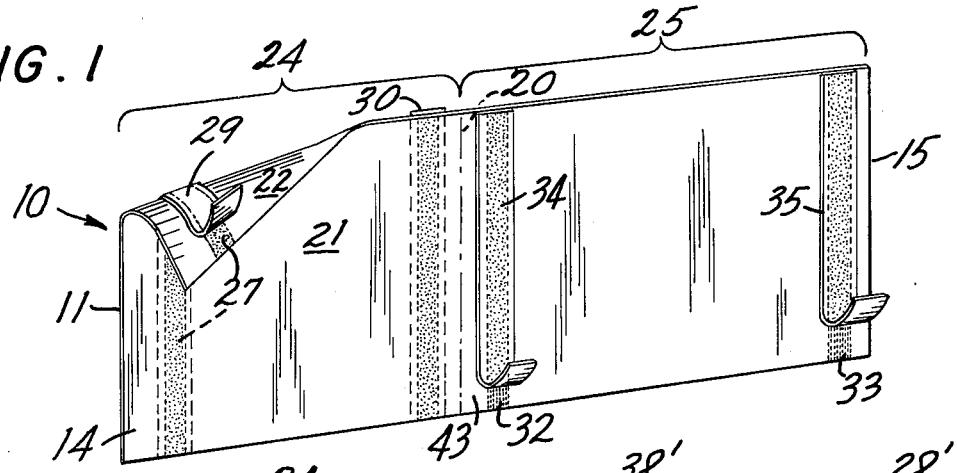
FIG. 2
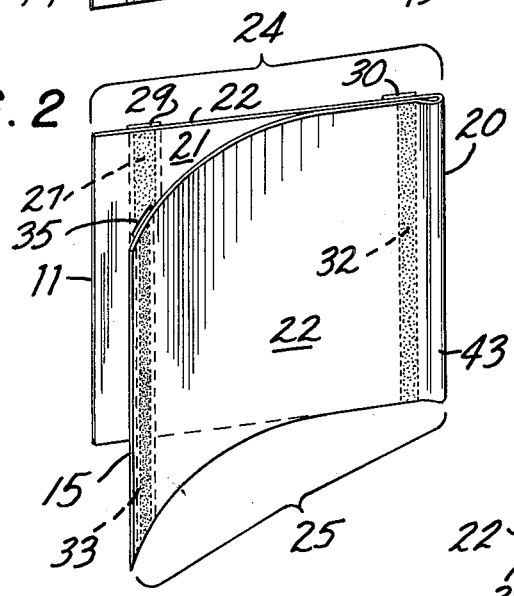
FIG. 5
PRIOR ART
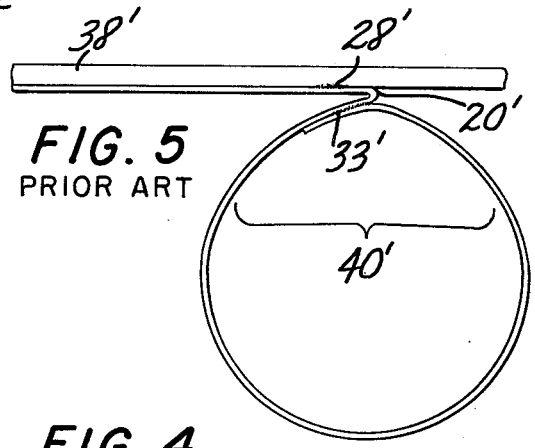
FIG. 4
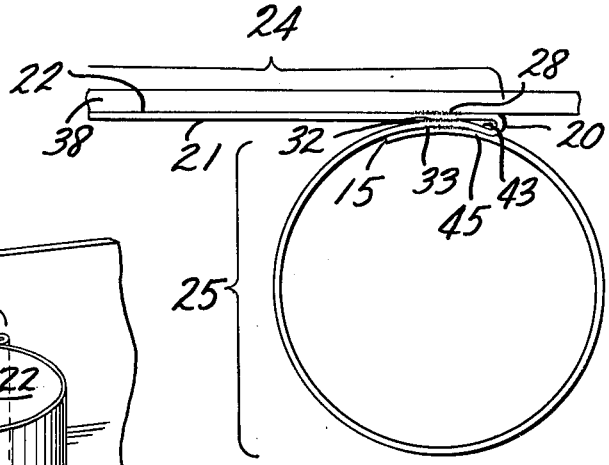
FIG. 3
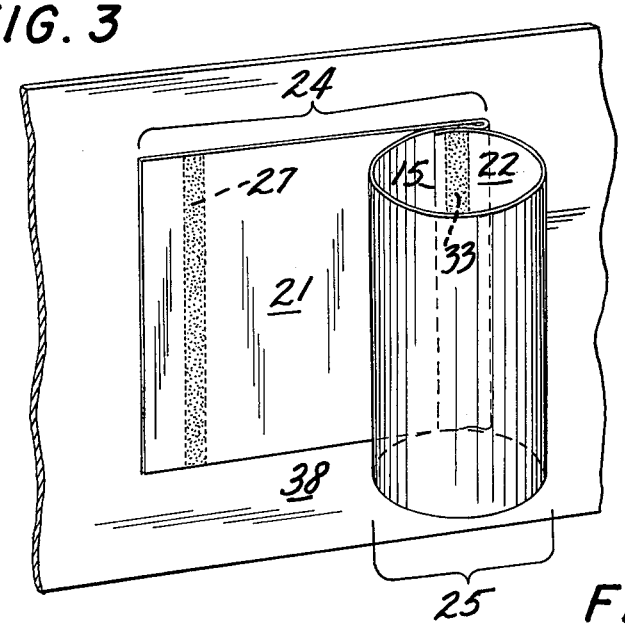
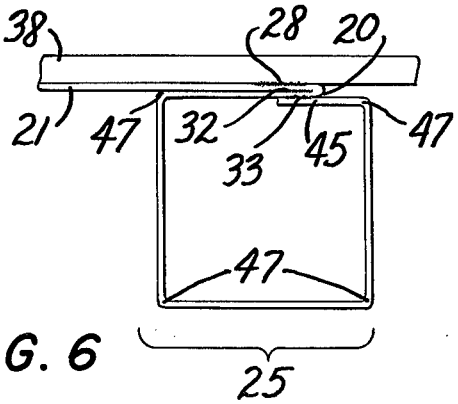
FIG. 6

DISPLAY DEVICE

BACKGROUND OF THE INVENTION

This invention relates to a display device, and in particular to a display device in which flat sheet material is adapted for arrangement in a three-dimensional configuration.

In the prior art several arrangements are known whereby paper or like printed sheet material is formed into a three-dimensional arrangement for advertising purposes. For example, one prior art patent suggests mounting the back of a magazine cover on a special easel. Advertising matter is mounted over the magazine back and is visible. The front of the magazine cover is rolled or folded along one edge of this arrangement, and paper fasteners secure the magazine cover in its desired position. Of course, the purpose of this arrangement is to associate the advertised product with the magazine.

More pertinent are applicant's own prior art attempts to provide a display such as is successfully provided according to this invention. In these earlier attempts, applicant provided a sheet of printed advertising matter wherein, as here, a center fold line divided the sheet. One section of the sheet carried adhesive on its back surface for attachment to a supporting member. The sheet portion between the fold line and the adhesive bearing edge was generally, but not entirely satisfactorily, cylindrically disposed. In these prior art arrangements the fold line was, in some instances, a printed line designating the crease to be made by the end user, and in other instances, a heat fold permanently implaced. The fold or crease acted as a hinge and made the generally cylindrical section unstable. Slight reopening of the crease could vary the location of printed matter on the cylinder. Where the generally cylindrical shape approached the fold, the display visibly deviated from the cylindrical.

BRIEF SUMMARY OF THE INVENTION

According to this invention an improved display is provided that substantially overcomes the prior art problems noted above. The improvement over the applicant's prior three-dimensional advertising displays results from inclusion of adhesive on the front surface of the sheet close to the fold line that divides the sheet.

When one section of the sheet is arranged in its outwardly projecting three-dimensional configuration, the adhesive near the fold line secures that configuration, preventing hinge-like action at the crease formed along the fold line. This prevents the three-dimensional shape from rocking on the slightest disturbance by wind, vibration or the like. Moreover the entire three-dimensional section cannot be displaced by a slight opening of the crease.

In both the cylindrical arrangement and other three-dimensional arrangements, the adhesive and crease combination correctly positions the three-dimensional part of the display. Printed matter on the outwardly projected surface is accurately located and is not subject to variations in positioning that result from varying degrees of reopening of the crease.

In the case of the cylinder, the adhesive near the sheet-dividing crease improves the cylindrical shape, particularly in that part of the cylinder near the crease. There the tangential meeting of the supporting sheet and the cylinder is provided at the adhesive, slightly removed from the crease. In the prior art such cylinders appeared flattened in this same area. The improved shape is visible and makes a more convincing can or like cylindrical container when the cylinder is printed to represent such.

The adhesive can be a strip of pressure sensitive adhesive applied preferably parallel to and a short distance from the fold line. If the three-dimensional shape is cylindrical, a small area free of adhesive between the crease and the adhesive in the cylinder-forming section of the display bows slightly to support the cylinder and to help shape the cylinder near the tangential meeting of the support section and cylinder.

The invention will be more fully understood from the following detailed description of exemplary preferred embodiments considered with the several figures of the accompanying drawings.

In the drawings:

FIG. 1 is a perspective view showing an advertising display device according to the invention, disposed in planar configuration.

FIG. 2 is a further perspective view that illustrates the manner of folding a display device according to the invention with adhesive securing the front surfaces of the device face-to-face adjacent the fold.

FIG. 3 is a perspective view showing the device of FIGS. 1 and 2 in three-dimensional configuration.

FIG. 4 is an enlarged fragmentary top plan view of the display device arranged as in FIG. 3 and better illustrates the fold line, adhesive, and three-dimensional arrangement of the device.

FIG. 5 is an enlarged fragmentary top plan view of a prior art arrangement.

FIG. 6 is an enlarged fragmentary top plan view of a display according to the invention and shows the three-dimensional display section arranged in rectangular cross-section.

DESCRIPTION OF THE PREFERRED EMBODIMENT

In FIG. 1, an advertising display device 10 includes a generally rectangular sheet 11 extending from a first edge 14 to a further edge 15. The sheet 11 can be any of a wide variety of materials suitable for the printing of advertising copy on a front surface 21. Paper, or any of numerous thermoplastic materials, is suitable. In one preferred embodiment a known metallic appearing commercially available plastic sheet, containing vacuum deposited metal is used to suggest a can when the sheet 11 is arranged in its three-dimensional display configuration.

A dividing fold line 20 divides the sheet 11 into sections that shall be called a first, supporting section 24 and a second section 25 that is to form the three-dimensional display shape. In the section 24 a back surface 22 of the sheet 11 bears pressure sensitive adhesive strips 27 and 28, covered until the device 10 is to be used, with known, paper release strips 29 and 30. Additional strips 32 and 33 of pressure sensitive adhesive are carried on the front surface 21 in the section 25 and are similarly covered by paper release strips 34 and 35 to be pulled away when the display device is to be used.

In use, the sheet 11 is first creased as shown in FIG. 2, bringing the front surfaces of the section 24 and 25 face-to-face. The crease at the line 20 can be made by the end user, or preferably, a heat fold can be formed, permanently and accurately locating the crease, when the material of the sheet 11 is thermoplastic or any material susceptible to permanent creasing in this manner.

The arrangement of the display device 10 for use is clear from FIGS. 3 and 4. With the release strips removed, adhesive strips 27 and 28 secure the support section 24 flat against a support surface 38. Section 25 is curled into a cylindrical shape, and the adhesive strip 33 near the further edge 15 of the section 25 secures that edge, near the crease along the fold line 20 to hold the section 25 cylindrical. The adhesive strip 32 near the fold line 20 secures together in face-to-face relationship adjacent portions of the sections 24 and 25 on opposite sides of the fold line 20.

Because it is secured at the adhesive 32, as shown best in FIG. 4, the generally cylindrical section 25 cannot pivot about the crease along line 20, and the display is more stable. The adhesive 32 also accurately locates the cylindrically configured section 25 so that any printing thereon is appropriately displayed. Once the cylinder is accurately located the adhesive 32 secures the cylindrically disposed section 25 to the face of the support section 24 and prevents opening of the fold, previously encountered in prior art arrangements such as that shown in FIG. 5. Moreover, by securing the cylinder to the surface 21 of the support section 24, the adhesive 32 contributes to a more perfect cylindrical shape, enabling the cylindrical section 25 more accurately to represent a can or similar container. Without being secured to the face of the supporting section 24 adjacent the line 20, the cylindrical section, in the area designated 40' in FIG. 5, ordinarily extends away from the fold 20' in a section of reduced curvature that does not conform to the remainder of the cylindrical configuration. The tendencies of the cylinder to uncurl and of the crease to open appear to contribute to this deviation. Attachment by the adhesive 32, as seen in FIG. 4 provides a more convincing tangential meeting of the support section 24 and a more evenly curved cylinder surface, hence a better visual display. On each side of the adhesive 32 the cylindrical curvature is improved.

A slight adhesive free area 43 between the fold line 20 and the adhesive 32 bows when the adhesive 32 secures the two sections 24 and 25 together. This bowing, again best seen in FIG. 4, supports the cylinder in the area designated 45 where it curves away from the supporting surface 38 and urges the cylindrically configured area 45 near the edge 15 towards a more nearly perfect cylindrical shape.

In one preferred embodiment the length of section 25 was 8¾ in. (22.2 cm.), area 43 was 5/16 in. (0.8 cm.) wide and each adhesive strip width was 5/16 in. (0.8 cm.) wide. Adhesive strip 33 was spaced ¼ in. (0.6 cm.) from the edge 15.

In the modification shown in FIG. 6 again like numerals identify like parts. The projecting three-dimensional arrangement is rectangular in cross-section to represent a box or similar container. Other polyhedral shapes are obtainable as well. Appropriate lines of fold 47 are chosen to define the desired shape. These lines of fold 47 can conveniently be permanently heat-formed at about the time the display is printed. The adhesive 32 and crease 20 combination holds the arrangement relatively steady against vibration and slight air currents, and prevents the crease at line 20 from opening hinge-like to displace the three-dimensional section of the display.

Many modifications of the above-described embodiment are possible without departure from the inventive concepts. For example the angular disposing of the two section 24 and 25 of the sheet along a fold line 20 that is parallel to the further edge 15 but angularly disposed relative to the first edge 14 results in a tilted cylinder with an axis that is diagonally disposed relative to the supporting section 24 of the sheet 11. Nor is it necessary that the supporting section 24 be rectangular, provided that section gives adequate support by adhesive applied to the back surface thereof. Further modifications of the preferred embodiment will be apparent to those skilled in the art and may be made within the spirit and scope of the invention as defined in the appended claims.

I claim:

1. A display device for arrangement into a three-dimensional configuration, comprising a thin, flexible sheet having a front information display surface, and a back surface, the sheet having a first section extending from a first edge to a dividing line, and a second section extending from the dividing line to a second edge, means, located on the first section of the sheet on said back surface thereof, for securing the device to a support surface, adhesive means located on said front surface proximate said line for securing together the front surface of said sections of the sheet on each side of said line and proximate thereto, and further means for attaching a portion of the second section proximate the second edge to said back surface near said dividing line, whereby upon arrangement of said device in its three-dimensional configuraion, said adhesive means adjacent said dividing line secures together the front surface of said sections adjacent a crease along said dividing line and said second section projects forward of the plane of the first section in a three-dimensional configuration, with said edge portion attached to said back surface near said line.

2. The display device according to claim 1, further including a permanent crease defined in said sheet along said dividing line and disposing the front surface of the first and second sections face-to-face.

3. The display according to claim 1 wherein the means for attaching a portion of the second section proximate the second edge to said back surface near the line is adhesive carried on the front surface near the second edge.

4. The display device according to claim 1, wherein the adhesive means located on said front surface proximate said line comprises a strip of pressure sensitive adhesive generally parallel to the dividing line.

5. The display device according to claim 1, wherein the means for securing, the adhesive means, and the further means for attaching all comprise release strip covered pressure sensitive adhesive.

6. The display device according to claim 1, wherein said sheet comprises metal-containing plastic sheet, whereby the said second section has the appearance of a metal container when the device is arranged in its three-dimensional configuration.

7. The display device according to claim 1, wherein the adhesive means located on said front surface adjacent said line is spaced a short distance from said line defining a narrow adhesive-free area between the line and the adhesive means whereby, in the three-dimensional configuration with said second section cylindrically disposed, the cylindrical second section is tangential to the first section a short distance from the fold, and said adhesive-free area bows into contact with the cylindrically shaped section where the cylinder approaches the tangential location near the crease.

8. The display device according to claim 1, wherein lines of fold are provided in said section to define a polyhedral shape when the second section is arranged in three-dimensional configuration.

* * * * *

UNITED STATES PATENT AND TRADEMARK OFFICE

CERTIFICATE OF CORRECTION

PATENT NO. : 3,971,149

DATED : July 27, 1976

INVENTOR(S) : Oliver Morley Tanney

It is certified that error appears in the above-identified patent and that said Letters Patent are hereby corrected as shown below:

Column 4, line 38, after "display" insert --device--;

Column 4, line 68, after "said" insert --second--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*